US008002562B2

(12) United States Patent
Lee

(10) Patent No.: US 8,002,562 B2
(45) Date of Patent: Aug. 23, 2011

(54) RECEPTACLE

(75) Inventor: Tsung-Shih Lee, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 95 days.

(21) Appl. No.: 12/580,411

(22) Filed: Oct. 16, 2009

(65) Prior Publication Data

US 2011/0092108 A1 Apr. 21, 2011

(51) Int. Cl.
*H01R 13/62* (2006.01)

(52) U.S. Cl. ..... 439/159; 439/352

(58) Field of Classification Search ..... 439/159, 439/352

See application file for complete search history.

(56) References Cited

U.S. PATENT DOCUMENTS 7,708,574 B2 * 5/2010 Maruyama ..... 439/159
7,744,391 B2 * 6/2010 Yu et al. ..... 439/159
7,794,249 B2 * 9/2010 Yu et al. ..... 439/159
7,819,678 B2 * 10/2010 Ye et al. ..... 439/159
7,901,225 B2 * 3/2011 Maruyama ..... 439/159
2009/0311903 A1 * 12/2009 Bychkov et al. ..... 439/352
2010/0112845 A1 * 5/2010 Lam et al. ..... 439/352

* cited by examiner

*Primary Examiner* — Gary F. Paumen
(74) *Attorney, Agent, or Firm* — WPAT, P.C.; Anthony King

(57) ABSTRACT

A receptacle for receiving a plug-in module with at least one depression at a side surface thereof includes a main body, an elastic element, a first resilient strip and a control element. The main body has a receiving chamber penetrating a bottom thereof for engaging the plug-in module and a first slot extending up and down defined in a front surface thereof and connecting the receiving chamber. The elastic element has an elastic portion received in an upper portion of the receiving chamber. The first resilient strip is received in the first slot, and defines a locking portion extending rearward at a lower portion thereof and penetrating into the receiving chamber for buckling to the depression of the plug-in module. The control element is for driving the locking portion to depart from the depression of the plug-in module for allowing the plug-in module to move outward due to the pulling of the elastic element.

10 Claims, 3 Drawing Sheets

RECEPTACLE

BACKGROUND OF THE INVENTION

1. Field of the Invention

The present invention relates to a receptacle, and in particular to a receptacle capable of receiving a plug-in module firmly as well as releasing the plug-in module conveniently.

2. The Related Art

Nowadays, in order to expand the function thereof and use conveniently, a portable electronic device has a unplugable plug-in module of particular function. The portable electronic device includes a receptacle disposed therein. The receptacle has an insertion opening exposed outside for receiving the plug-in module.

A special plug-in module, such as a USB module, includes a metal shell with an opening defined at a side plate thereof. Conventionally, the receptacle has an elastic locking structure for elastically resisting against the metal shell of the plug-in module, when the plug-in module is inserted therein. But, when the portable electronic device suffers from an outer force, the plug-in module is easy to produce a displacement corresponding to the locking structure of the receptacle. Moreover, it is difficult to unplug the plug-in module from the receptacle, when the plug-in module is required to use, because of lack of a driving structure for driving the plug-in module exit from the receptacle. Therefore, a receptacle capable of overcoming the foregoing problem is required.

SUMMARY OF THE INVENTION

It is an object of the present invention to provide a receptacle capable of receiving a plug-in module firmly as well as releasing the plug-in module conveniently.

In order to achieve foregoing objective, the receptacle for receiving a plug-in module with at least one depression at a side surface thereof includes a main body, an elastic element, a first resilient strip and a control element. The main body has a receiving chamber penetrating a bottom thereof for engaging the plug-in module and a first slot extending up and down defined in a front surface thereof and connecting the receiving chamber. The elastic element has an elastic portion received in an upper portion of the receiving chamber and capable of providing a downward pulling force to the plug-in module due to the upward compression by the plug-in module. The first resilient strip is received in the first slot, and defines a locking portion extending rearward at a lower portion thereof and penetrating into the receiving chamber for buckling to the depression of the plug-in module. The control element is for driving the locking portion to depart from the depression of the plug-in module for allowing the plug-in module to move outward due to the pulling of the elastic element.

As the above description, the locking portion of the first resilient strip could buckle to the depression of the plug-in module and the control element could drive the locking portion to depart from the depression of the plug-in module for allowing the plug-in module to move outward under the pulling of the elastic element. Therefore, the receptacle is able to receive the plug-in module firmly and release the plug-in module conveniently.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
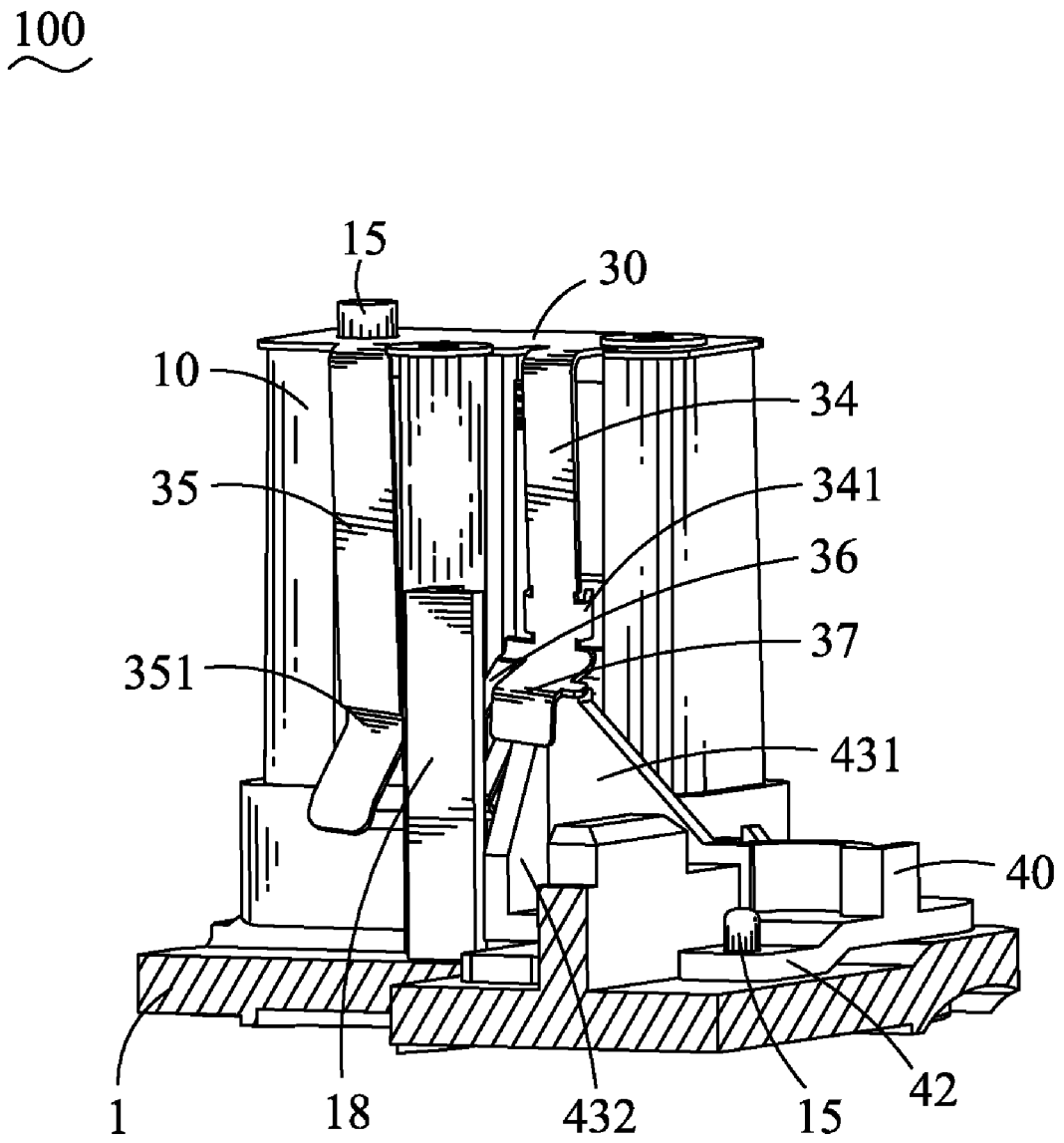
FIG. 1 is a perspective view of a receptacle according to the present invention with a plug-in module therein.
Figure 2:
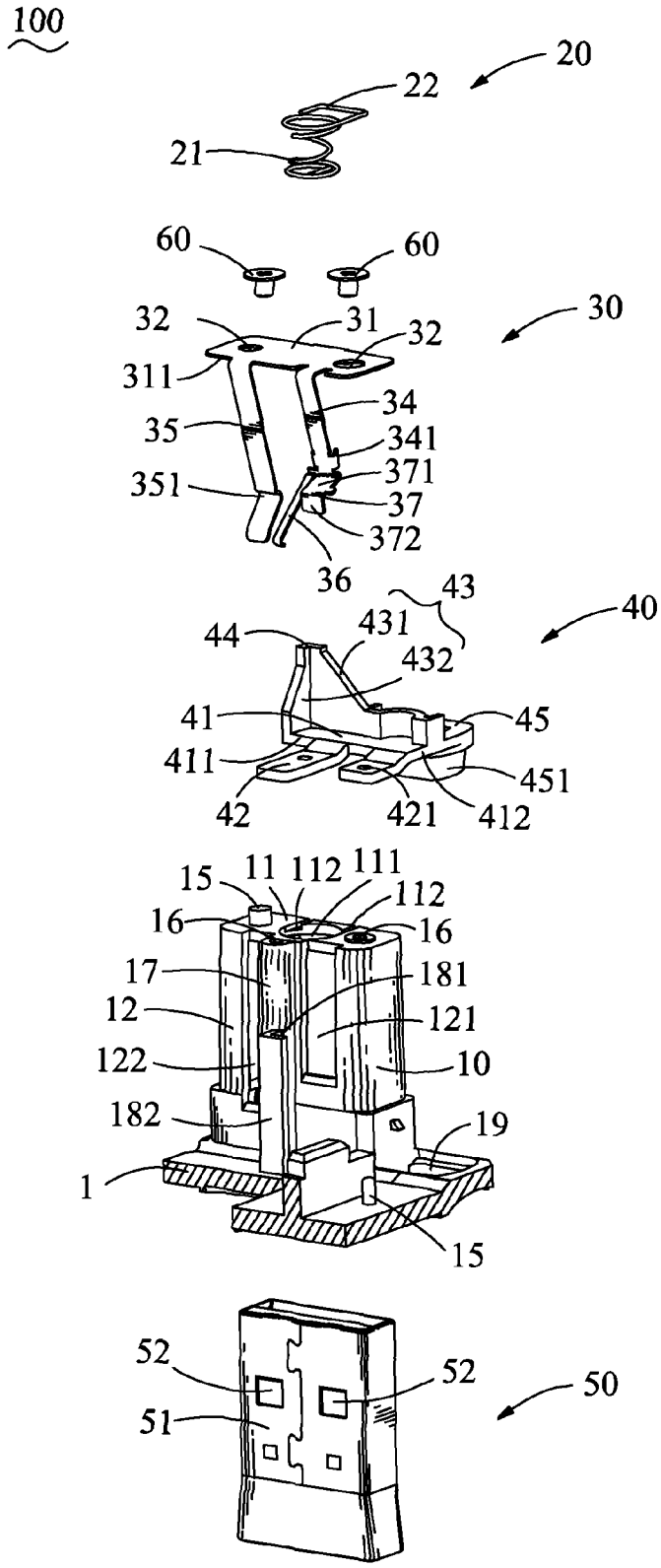
FIG. 2 is an exploded view of the receptacle with the plug-in module.

Referring to FIGS. 1 and 2, the receptacle 100 in accordance with the present invention includes a base plate 1, a main body 10, an elastic element 20, an elastic piece 30 and a control element 40.

Figure 4:
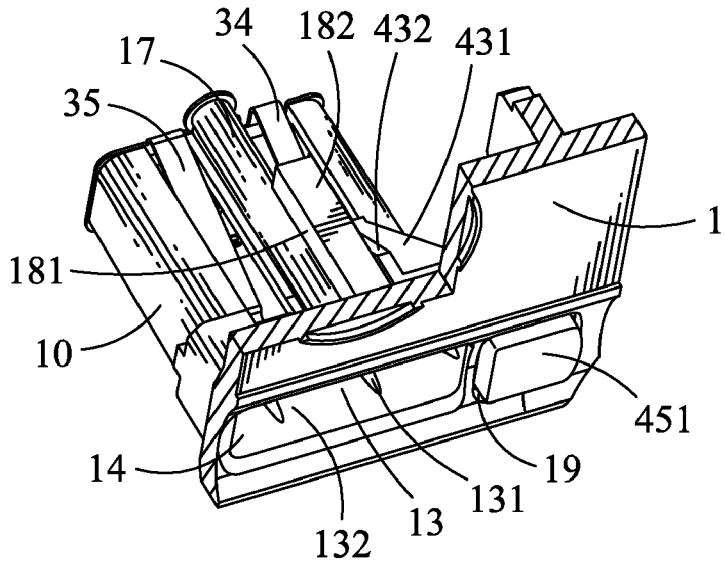
FIG. 4 is a perspective view of the receptacle without the plug-in module therein.

With referring to FIGS. 1, 2 and 4, the main body 10 protrudes upward from the base plate 1 which is a part of a case of a portable electronic device. The main body 10 shows substantially a rectangular shape and includes a top surface 11, a front surface 12 and a rear surface (not shown). The main body 10 further includes a receiving chamber 13 penetrating the top surface 11 and the base plate 1, and then respectively forms a circular hole 111 in a middle of the top surface 11 and a rectangular insertion opening 14 on the base plate 1. A plural of ridges 131 extend inward on inner surfaces 132 of the receiving chamber 13. A pair of grooves 112 penetrates a rear edge of the top surface 11 and extends frontward to connect the circular hole 111. Each of the grooves 112 is perpendicular to the rear surface of the main body 10 and tangent with a circumference of the circular hole 111. A fixing portion 15 protrudes from a side of the top surface 11 and a screw hole 16 is defined on the other side of the top surface 11. A first slot 121 and a second slot 122, both of which connect the receiving chamber 13, respectively penetrate a top edge of the front surface 12 and extend downward in two sides of the front surface 12. The second slot 122 is longer than the first slot 121. A cylinder portion 17 has a same height with the main body 10 and protrudes upward from the base plate 1. Another screw hole 16 is defined in a top surface of the cylinder portion 17. An outer peripheral surface of the cylinder portion 17 connects a portion of the front surface 12 between the first slot 121 and the second slot 122. A preventing part 18 extends upward from the base plate 1 and locates in front of the cylinder portion 17. The preventing part 18 has a first slim plate 181 and a second slim plate 182 which is substantially perpendicular to the first slim plate 181. One long side of the first slim plate 181 connects the outer peripheral surface of the cylinder portion 17 and the other long side of the first slim plate 181 extends away from the second slot 122 to form the second slim plate 182.

As shown in FIG. 2, the elastic element 20 has an elastic portion 21 and a holding portion 22. The elastic portion 21 could regain its original shape after being compressed or extended, such as a coil spring. The holding portion 22 extends from a free end of the elastic portion 21 to show a substantially U-shape suspended over the elastic portion 21. Two opposing arms of the holding portion 22 are slightly longer than the grooves 112 in the top surface 11 of the main body 10.

Figure 3:
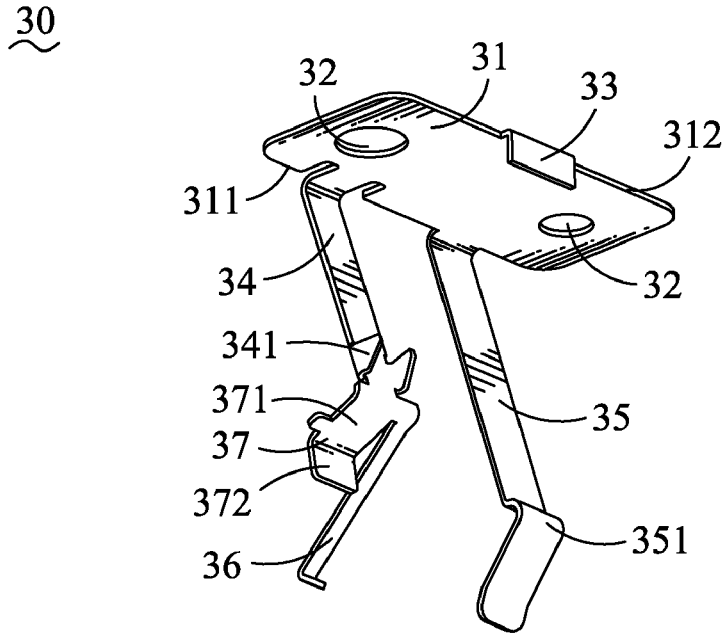
FIG. 3 is a perspective view of an elastic piece of the receptacle.

Referring to FIGS. 2 and 3, the elastic piece 30 made of a metal sheet has a substantially rectangular sheet-shaped main portion 31, two sides of which are respectively punched to form a mounting hole 32 corresponding to the fixing portion 15 and the screw hole 16 on the top surface 11 of the main body 10. The main portion 31 has a front side 311 and a rear side 312. The rear side 312 extends downward a bit to form an insertion piece 33 at a middle thereof. A first resilient strip 34 and a second resilient strip 35 respectively extend downward from two ends of the front side 311 and slant rearward slightly. The second resilient strip 35 is longer than the first resilient strip 34 and has a curved portion 351 projecting rearward at a portion adjacent to a distal end thereof. The first resilient strip 34 defines two blades 341 respectively extending rearward from two opposing sides adjacent to a distal end thereof. A slim branch 36, which is adjacent to the second resilient strip 35, extends frontward from a side of the distal end of the first resilient strip 34 and tilts downward. A preventing piece 37 which has a small space from the slim branch 36 extends from the other side of the distal end of the first resilient strip 34 and shows substantially inverted-L shaped. The preventing piece 37 includes a connecting portion 371 extending frontward from the other side of the distal end of the first resilient strip 34 and inclining downward slightly, and a preventing portion 372 extending downward from a distal end of the connecting portion 371.

Please refer to FIG. 2 once again, the control element 40 has a substantially plate-shaped base portion 41 which has a front side 411, a rear side (not shown) opposite to the front side 411 and two opposing lateral sides 412 perpendicularly connecting the front side 411 and the rear side. Two strip-shaped fixing pieces 42, which have a small space from each other, extend frontward from the front side 411 of the base portion 41 and have two fixing holes 421 respectively passing therethrough. A preventing unit 43 which is defined at a corner of the base portion 41 includes a rear plate 431 and a side plate 432. The rear plate 431 extends perpendicularly upward from an end of the rear side of the base portion 41. The side plate 432 extends perpendicularly upward from one of the lateral sides 412 and perpendicularly connects the rear plate 431. Upper portions of the side plate 432 and the rear plate 431 are together defined as a supporting portion 44. A button seat 45 away from the preventing unit 43 extends rearward from the other end of the rear side of the base portion 41 and defines a release button 451 protruding downward from a middle portion thereof.

Referring back to FIGS. 1-4, when the receptacle 100 is assembled, the control element 40 is secured in front of the main body 10 by means of fastening two corresponding fixing portions 15 which protrude from the base plate 1 respectively into the fixing holes 421. The preventing unit 43 is corresponding to the first slot 121, with the rear plate 431 against the front surface 12 of the main body 10 and the side plate 432 against a free long side of the second slim plate 182. The release button 451 protrudes out of a button groove 19 which is formed on the base plate 1 and beside the main body 10. The elastic portion 21 of elastic element 20 stretches into the receiving chamber 13 from the circular hole 111. The holding portion 22 has its two opposing arms respectively located in the grooves 112 and stretched rearward beyond the main body 10 to form an insertion space. Consequently, the insertion piece 33 inserts into the insertion space to fix the elastic element 20 on the top surface 11 of the main body 10 and the fixing portion 15 on the top surface 11 protrudes through the corresponding mounting hole 32 to position the elastic piece 30, when the main portion 31 covers the top surface 11 of the main body 10. At the same time, the second resilient strip 35 is received in the second slot 122 with the curved portion 351 projecting into the receiving chamber 13 and the first resilient strip 34 is received in the first slot 121 with the blades 341 penetrating into the receiving chamber 13. The slim branch 36 tilts into a space formed by the first slim plate 181, the second slim plate 182 and the side plate 432. A free end of the slim branch 36 is against a rear surface of the second slim plate 182. The preventing portion 372 is hooked to a front of the supporting portion 44. Finally, two screws 60 are respectively tightened up in the corresponding screw holes 16 to further fasten the elastic piece 30 to the main body 10.

Referring back to FIG. 2, a plug-in module 50 has two opposite side surfaces 51 and has two depressions 52 respectively formed in two sides of each side surface 51. When the receptacle 100 is in use, the plug-in module 50 is inserted into the receiving chamber 13 from the insertion opening 14 and then compresses the elastic portion 21 of the elastic element 20. The curved portion 351 of the second resilient strip 35 and the blades 341 of the first resilient strip 34 are against the side surface 51, and then the blades 341 buckles to one of the depressions 51, thereby the plug-in module 50 is held firmly in the receptacle 100. Moreover, the ridges 131 formed on the inner surface 132 of the receiving chamber 13 could reduce the contact area between the inner surface 132 and the side surfaces 51 of the plug-in module 50, so as to reduce the attrition of the plug-in module 50 effectively.

When the plug-in module 50 is removed from the receptacle 100, the release button 451 is pushed and the preventing unit 43 is led to incline frontward. The preventing piece 37 is pushed forward by the supporting portion 44 of the preventing unit 43 so as to lead the blades 341 to depart from the depression 51, and then the plug-in module 50 is ejected downward by means of release of the elastic portion 21. Whereafter, the first resilient strip 34 is moved rearward by means of release thereof and the preventing piece 37 pushes the supporting portion 44 to return the control element 20 to a previous location. Furthermore, a release of the slim branch 36, which is pressed against the rear surface of the second slim plate 182 when the plug-in module 50 is inserted in the receiving chamber 13, strengthens a push force of the preventing piece 37 to the supporting portion 44 when the plug-in module 50 is ejected. Because the second resilient strip 35 is longer than the first resilient strip 34, the curved portion 351 of the second resilient strip 35 is still pressed against the side surface 51 of the plug-in module 50 and then buckles to the other depression 52 as the plug-in module 50 continues being pushed outward. Therefore, the plug-in module 50 is prevented from being directly ejected out of the receiving chamber 13 by excessive force of the releasing elastic portion 21. By this time, the plug-in module 50 could be taken out of the receptacle 100 easily and prevented from damage.

In addition, because the depth of depressions 52 is different on two opposing side surfaces 51 of the plug-in module 50, the blades 341 are not easy to buckle to the depression 51 which has a less depth. Therefore, the release of the slim branch 36 strengthens a push force of the first resilient strip 34 to enable the blades 341 to buckle to the depression 51 firmly. Because of the first slim plate 181 and the side plate 432 of the preventing unit 43, the free end of the slim branch 36 would not deviate from the rear side of the second slim plate 182 even when a press force on the slim branch 36 is excessively great.

As described above, the blades 341 of the first resilient strip 34 could buckle to the depression 52 of the plug-in module 50 and the control element 40 could drive the blades 341 departing from the depression 52 of the plug-in module 50 to allow the plug-in module 50 to move outward under the pulling of the elastic element 20. Therefore, the receptacle 100 is able to receive the plug-in module 50 firmly and release the plug-in module 50 conveniently.

What is claimed is:

1. A receptacle for receiving an plug-in module with at least one depression at a side surface thereof, comprising:

a main body having a receiving chamber penetrating a bottom thereof for engaging the plug-in module, and a first slot extending up and down defined in a front surface thereof and connecting the receiving chamber;

an elastic element including an elastic portion received in an upper portion of the receiving chamber and capable of providing a downward pulling force to the plug-in module due to the upward compression by the plug-in module;

a first resilient strip received in the first slot, wherein the first resilient strip extends downward from a front side of a main portion and slants rearward slightly, the main portion is fixed to a top surface of the main body;

a locking portion extending rearward at a lower portion thereof and penetrating into the receiving chamber for buckling to the depression of the plug-in module, wherein the locking portion is two facing blades respectively extending rearward from two opposite sides of the lower portion of the first resilient strip;

a control element for driving the locking portion to depart from the depression of the plug-in module for allowing the plug-in module to move outward due to the pulling of the elastic element.

2. The receptacle as claimed in claim 1, further comprising a base plate where the main body extending upward, the control element having a substantially plate-shaped base portion fixed on the base plate, a preventing unit extending upward from a side of the base portion and defining an upper portion thereof as a supporting portion, and a release button away from the preventing unit extending rearward from a rear side of the base portion and protruding out of a button groove which is formed on the base plate beside the main body, wherein a distal end of the first resilient strip extending frontward and bending downward to form a preventing piece of substantially inverted-L shape, the preventing piece is hooked to a front of the supporting portion.

3. The receptacle as claimed in claim 2, further comprises a preventing part protruding upward from the base plate and located in front of the main body, the first resilient strip has a slim branch extending frontward therefrom for being pressed against a rear surface of the preventing part when the plug-in module is inserted and strengthening a push force of the preventing piece to the supporting portion when the plug-in module is ejected.

4. The receptacle as claimed in claim 3, wherein the slim branch extends frontward from the distal end of the first resilient strip and tilts downward, with a space from the preventing piece.

5. The receptacle as claimed in claim 3, wherein the preventing part has a first slim plate perpendicular to the front surface of the main body, a second slim plate perpendicularly extending from a long side of the first slim plate for being against a free end of the slim branch.

6. The receptacle as claimed in claim 5, wherein the base portion of the control element has a lateral side perpendicularly connecting to a rear side thereof, the preventing unit defines a side plate extending perpendicularly upward from the lateral side, the side plate is against a free long side of the second slim plate to form a space with the first slim plate and the second slim plate, the slim branch tilts into the space and is prevented deviating from the rear surface of the second slim plate even when a press force thereon is excessively great.

7. The receptacle as claimed in claim 1, wherein the front surface of the main body further defines a second slot extending up and down and connecting the receiving chamber, for receiving a second resilient strip longer than the first resilient strip, a curved portion projects rearward at a portion adjacent to a distal end of the second resilient strip for buckling to another depression of the plug-in module when the plug-in module is pushed outside by the downward pulling force from the elastic element.

8. The receptacle as claimed in claim 7, wherein the first resilient strip and the second resilient strip both extends downward from a front side of a main portion and slants rearward slightly, the main portion is fixed to a top surface of the main body.

9. The receptacle as claimed in claim 1, further comprising a base plate where the main body extending upward, the control element having a substantially plate-shaped base portion fixed on the base plate in front of the main body, the base portion defines two strip-shaped fixing pieces extending frontward from a front side thereof and being spaced from each other, each of the fixing pieces has a fixing hole for being engaged with a corresponding fixing portion protruding from the base plate to secure the control element.

10. The receptacle as claimed in claim 1, wherein the elastic element further has a holding portion extending from a free end of the elastic portion showing a substantially U-shape suspended over the elastic portion, the receiving chamber penetrates a top surface of the main body and then forms a circular hole in the middle of the top surface, a pair of grooves penetrates a rear edge of the top surface and extends frontward to connect the circular hole, two opposing arms of the holding portion which are slightly longer than the grooves respectively locate in the grooves and stretch rearward beyond the main body to form an insertion space, a top surface of the main body has a main portion mounted thereon, an insertion piece extends downward from a rear side of the main portion for inserting into the insertion space to fix the elastic element on the top surface of the main body.

* * * * *